US011526131B2

(12) United States Patent
Bachmann

(10) Patent No.: US 11,526,131 B2
(45) Date of Patent: Dec. 13, 2022

(54) DEVICE FOR DISPLAYING A SUCCESSION OF PERIODIC EVENTS WHICH FORM AN ANNUAL CYCLE AND TIMEPIECE COMPRISING SUCH A DISPLAY DEVICE

(71) Applicant: ETA SA MANUFACTURE HORLOGERE SUISSE, Grenchen (CH)

(72) Inventor: Stephane Bachmann, Buren an der Aare (CH)

(73) Assignee: ETA SA MANUFACTURE HORLOGERE SUISSE, Grenchen (CH)

( * ) Notice: Subject to any disclaimer, the term of this patent is extended or adjusted under 35 U.S.C. 154(b) by 550 days.

(21) Appl. No.: 16/681,062

(22) Filed: Nov. 12, 2019

(65) Prior Publication Data

US 2020/0201258 A1 Jun. 25, 2020

(30) Foreign Application Priority Data

Dec. 21, 2018 (EP) ..... 18215120

(51) Int. Cl.
*G04B 19/26* (2006.01)
*G04B 19/253* (2006.01)

(52) U.S. Cl.
CPC ..... *G04B 19/262* (2013.01); *G04B 19/2532* (2013.01)

(58) Field of Classification Search
CPC ..... G04B 19/262; G04B 19/247; G04B 19/2532; G04B 19/26
See application file for complete search history.

(56) References Cited

U.S. PATENT DOCUMENTS 4,731,767 A * 3/1988 Uehara ..... G04B 19/26 968/207
5,023,849 A * 6/1991 Vaucher ..... G04B 19/26 368/15

(Continued)

FOREIGN PATENT DOCUMENTS

CN 2769959 Y 4/2006
CN 101057189 A 10/2007

(Continued)

OTHER PUBLICATIONS

Communication dated Feb. 1, 2021, from the China National Intellectual Property Administration in application No. 201911329094.6.

(Continued)

*Primary Examiner* — Edwin A. Leon
*Assistant Examiner* — Jason M Collins
(74) *Attorney, Agent, or Firm* — Sughrue Mion, PLLC

(57) ABSTRACT

A device (1), and timepiece having the device, for displaying a succession of periodic events which form an annual cycle, including a periodic events indicator member (2) and a mechanism (4) for managing a duration during which the periodic events are displayed by the periodic events indicator member (2). The management mechanism includes a cam (8) for managing a duration during which the periodic events are displayed, which cam is arranged such that it controls the change from the indication of a periodic event to the indication of a subsequent periodic event by the periodic events indicator member, a periodic driver (10) for driving the management cam (8) and a member (6) disposed between the management cam and the periodic events indicator member and arranged such that it drives the periodic events indicator member (2) during a change in event. The device displays the periods of the zodiac.

8 Claims, 8 Drawing Sheets

(56) References Cited

U.S. PATENT DOCUMENTS

| | | | | |
|---|---|---|---|---|
| 6,272,076 | B1 * | 8/2001 | Dinger | G04G 9/0076 368/15 |
| 2005/0013198 | A1 * | 1/2005 | Born | G04B 19/262 368/15 |
| 2005/0078558 | A1 | 4/2005 | Dalloz | |
| 2006/0221772 | A1 * | 10/2006 | Vuilleumier | G04C 17/0066 368/223 |
| 2007/0109916 | A1 | 5/2007 | Bron | |
| 2013/0051183 | A1 | 2/2013 | Gabathuler et al. | |
| 2016/0154378 | A1 | 6/2016 | Denden et al. | |

FOREIGN PATENT DOCUMENTS

| | | | |
|---|---|---|---|
| CN | 102692863 | A | 9/2012 |
| CN | 102692865 | A | 9/2012 |
| CN | 103123454 | A | 5/2013 |
| CN | 105652633 | A | 6/2016 |
| CN | 106292245 | A | 1/2017 |
| EP | 1 524 564 | A1 | 4/2005 |
| EP | 1 785 783 | A1 | 5/2007 |
| EP | 1785783 | B1 | 10/2011 |
| EP | 2 565 729 | A1 | 3/2013 |
| EP | 3 029 531 | A1 | 6/2016 |
| JP | 2016109689 | A | 6/2016 |

OTHER PUBLICATIONS

Communication dated Nov. 4, 2020, issued by the Japanese Patent Office in application No. 2019-223438.
European Search Report issued in EP 18 21 5210 dated Jun. 24, 2019.

* cited by examiner

DEVICE FOR DISPLAYING A SUCCESSION OF PERIODIC EVENTS WHICH FORM AN ANNUAL CYCLE AND TIMEPIECE COMPRISING SUCH A DISPLAY DEVICE

CROSS-REFERENCE TO RELATED APPLICATIONS

This application claims priority to European Patent Application No. 18215120.9, filed Dec. 21, 2018, the entire contents of which are incorporated herein by reference.

TECHNICAL FIELD OF THE INVENTION

The present invention relates to a device for displaying a succession of periodic events which form an annual cycle. The present invention in particular relates to a device for displaying the sequence of the periods of the zodiac. The present invention further relates to a timepiece comprising such a display device.

BACKGROUND ART

An annual cycle can be divided into a certain number of periods, each of which comprise the same number of days or different numbers of days.

By way of example, an annual cycle of twelve months can be divided into twelve periods, each of which corresponds to one of the twelve signs of the zodiac. The particularity of these zodiac periods is that the durations thereof are not identical: more specifically, these durations lie in the range 29 to 32 days. Moreover, the passage from one zodiac period to the next zodiac period takes place between the $20^{th}$ and the $23^{rd}$ of the month concerned, depending on the duration of the zodiac sign in question. For example, the period of the zodiac that corresponds to the Sagittarius sign lasts 29 days from the $23^{rd}$ of November to the $21^{st}$ of December, whereas the period of the zodiac that corresponds to the cancer sign lasts 31 days from the $22^{nd}$ of June to the $22^{nd}$ of July.

An annual cycle can also be divided into twelve periods corresponding to the twelve months of the year. These months have unequal durations that lie in the range 28 to 31 days.

Devices for displaying these periods are already known. The most rudimentary embodiments comprise a disc on which the different periods of an annual cycle are represented by means of angular sectors, the angle whereof varies as a function of the number of days in the period considered. A first embodiment consists of rotating the disc beneath a dial wherein an aperture is made through which the current period can be seen. Another embodiment consists of rotating the disc facing an index which points to the current period. Yet another embodiment consists of rotating a hand above the disc, the hand pointing to the current period.

Mechanisms for driving the disc on which the different periods of an annual cycle are shown, or for driving the hand which moves over such a disc are of the jumping or dragging type, and the advancement thereof is steady, such that the display of the current period lacks precision, in particular when passing from one period to the next. Moreover, displaying, on an element of a timepiece, time indications of differing durations whereas time itself passes at a constant rhythm, causes the timepieces concerned to be relatively ill-perceived.

A device for displaying periods forming an annual cycle is known from the patent document EP 3 029 531 A1 filed by Blancpain. The core of this display device is formed by a differential mechanism having two inputs and one output. A first input is constituted by a reference drive wheel arranged to perform a revolution according to a reference period. A second input is constituted by an activation member arranged to cooperate with a cam which has a profile arranged so that the cooperation between the activation member and the differential mechanism causes an indicator member for indicating the periods to advance or retreat as a function of the difference between the displayed period and the reference period. Finally, the output is constituted by a member for driving the indicator member.

Thanks to these features, the Blancpain display device allows for the regular representation of periods that are not necessarily all equal. Moreover, the choice of a differential mechanism for driving the display device allows the period indicator member to be positioned at any point along the perimeter of the dial of the timepiece that is equipped with this display device. However, it is well known that a differential mechanism requires a large number of parts and is delicate to adjust. As a result, such a display device is more or less reserved to top of the range parts with a high cost price.

SUMMARY OF THE INVENTION

The purpose of the present invention is to overcome the aforementioned problems and more, in particular by procuring a device allowing a succession of periodic events of unequal durations forming an annual cycle to be displayed in an equal manner.

For this purpose, the present invention relates to a device for displaying a succession of periodic events which form an annual cycle, this display device comprising:

- a periodic events indicator member;
- a mechanism for managing a duration during which the periodic events are displayed by the periodic events indicator member, this management mechanism comprising:
- a cam for managing a duration during which the periodic events are displayed, which cam is arranged such that it controls the change from the indication of a periodic event to the indication of a subsequent periodic event by the periodic events indicator member;
- periodic drive means for driving the management cam, and
- a member disposed between the management cam and the periodic events indicator member and arranged such that it drives the periodic events indicator member during a change in event.

According to special embodiments of the invention:

- the drive member disposed between the management cam and the periodic events indicator member comprises a lever that is elastically stressed against a profile of the cam for managing the duration during which the periodic events are displayed;
- the drive member comprises a hammer arranged between the management cam and the periodic events indicator member, this hammer comprising a feeler-spindle held, by the lever, such that it elastically bears against the profile of the cam for managing the duration during which the periodic events are displayed;
- the management cam is driven by a date mechanism and by a month mechanism;
- the date mechanism comprises a date drive wheel which drives a date indicator wheel at a rate of one step per day, this date indicator wheel performing one full revolution in 31 days, the month mechanism comprising a month drive finger integral with the date indicator wheel and which causes the management cam to advance by one twelfth of a revolution at the end of each of the twelve months of the year;

the month drive finger meshes with a month indicator wheel to which the management cam is fixed;

a planetary wheel is mounted idle on the lever and meshes with a sun wheel;

the date indicator wheel, the month drive finger, the sun wheel and the lever are concentric;

at the beginning of the months in which the periodic event change must take place on a day of this month that is different to the day of the month on which the previous periodic event change took place, the management cam controls the adjustment to the position of the lever, whereby the planetary wheel rolls on the sun wheel which remains fixed during the adjustment to the position of the lever;

on the day of the month on which the periodic event change takes place, the month drive finger meshes with the planetary wheel, which itself rotates the sun wheel;

the sun wheel drives the periodic events indicator member;

the periodic events indicator member is a periodic events indicator wheel which is indexed by a jumper and with which the sun wheel meshes;

when the periodic events indicator member is adapted to display the zodiac periods, the profile of the management cam has a first radius which allows the indicator member to change zodiac period during the night of the $22^{nd}$ to the $23^{rd}$ of the months of July, August, September, October and November, a second radius which is different from the first radius, which allows the indicator member to change zodiac period during the night of the $21^{st}$ to the $22^{nd}$ of the months of December and June, a third radius which is different from the first and second radii, which allows the indicator member to change zodiac period during the night of the $20^{th}$ to the $21^{st}$ of the months of January, March, April and May, and a fourth radius which is different from the first, second and third radii, which allows the indicator member to change zodiac period during the night of the $19^{th}$ to the $20^{th}$ of the month of February;

the profile of the management cam has a first portion having a first radius that is constant for the months of July, August, September, October and November, then a second portion having a second radius for the month of December, then a third portion having a third radius for the month of January, then a fourth portion having a fourth radius for the month of February, then a fifth portion having a third radius that is constant for the months of March, April and May, and finally a sixth and last portion having a second radius corresponding to the month of June.

The invention further relates to a timepiece comprising a device for displaying a succession of periodic events which form an annual cycle of the aforementioned type.

Thanks to these features, the present invention provides a mechanism for displaying periodic events forming an annual cycle, the construction whereof is relatively simple and which is compact. As a result of the relative constructive simplicity thereof, the display mechanism according to the invention involves a lower number of components, such that it is more cost-effective to produce and such that the operation thereof is more reliable. On the other hand, given that it is compact, the present display mechanism can be more easily housed inside a greater number of calibers, without these calibers constantly requiring modification.

BRIEF DESCRIPTION OF THE FIGURES

Other features and advantages of the present invention will be better understood upon reading the following detailed description of one example embodiment of a device for displaying the zodiac periods forming an annual cycle, said example being provided for the purposes of illustration only and not intended to limit the scope of the invention, given with reference to the accompanying drawing, wherein.

DETAILED DESCRIPTION OF ONE EMBODIMENT OF THE INVENTION

The present invention was drawn from the general inventive idea consisting of providing a device allowing periodic events to be displayed in an equal and continuous manner, which periodic events form an annual cycle and the durations whereof are not equal. For this purpose, the present invention provides a display device comprising a cam driven by a date and month indicator device and which, at the end of each month where necessary, pre-positions a lever such that, when reaching the day of passage from one periodic event to the periodic event immediately thereafter, a display member displays the relevant periodic event. Thanks to these features, the present invention thus provides a device for displaying periodic events forming an annual cycle which is continuously repositioned as a function of the day of the month on which the periodic event to be considered begins. Periodic events that do not necessarily succeed one another in a regular manner in time can thus be displayed, without this being perceivable to the owner of the timepiece.

Figure 1:
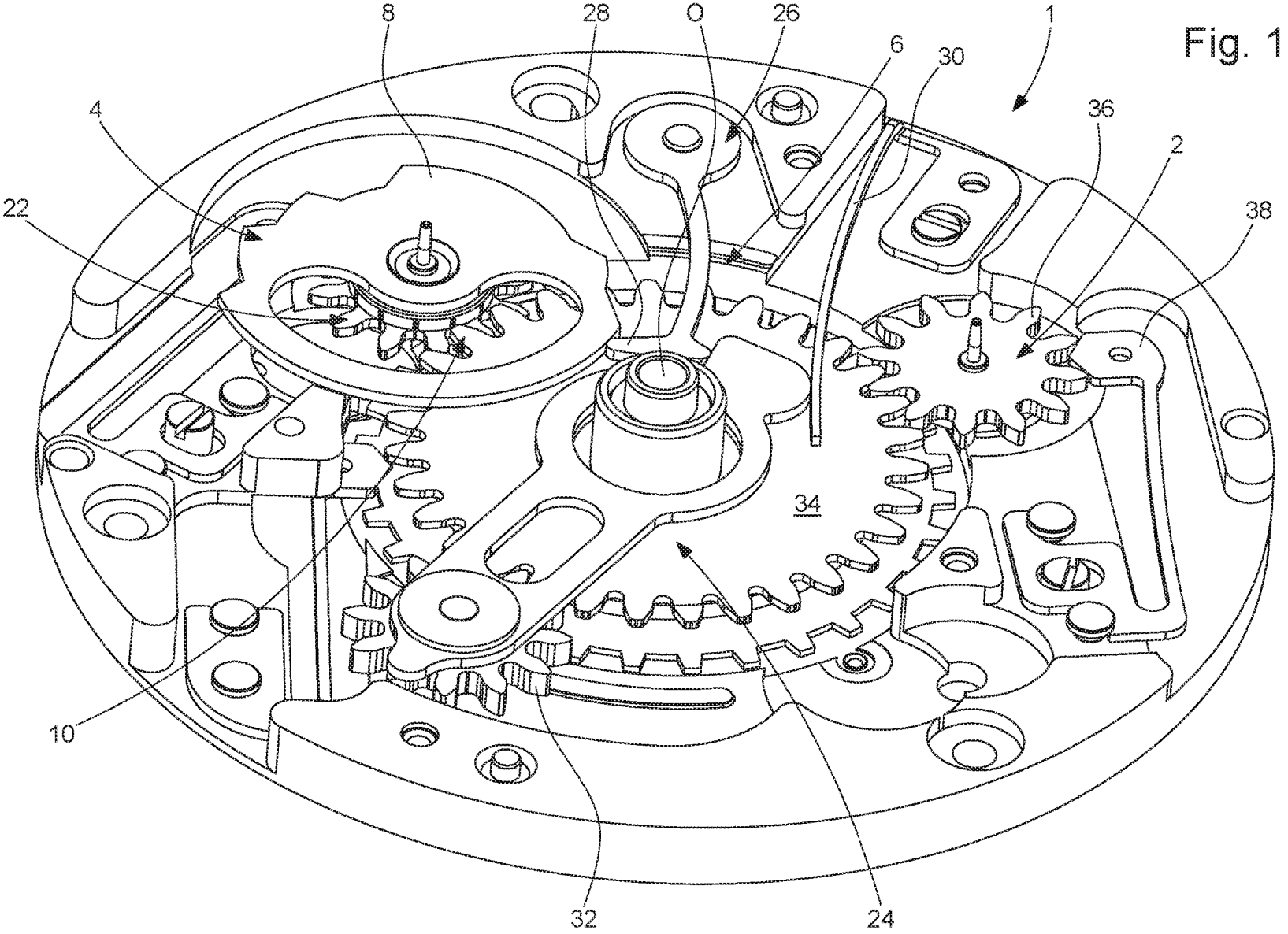
FIG. 1 is a perspective view of the display device according to the invention.
Figure 2:
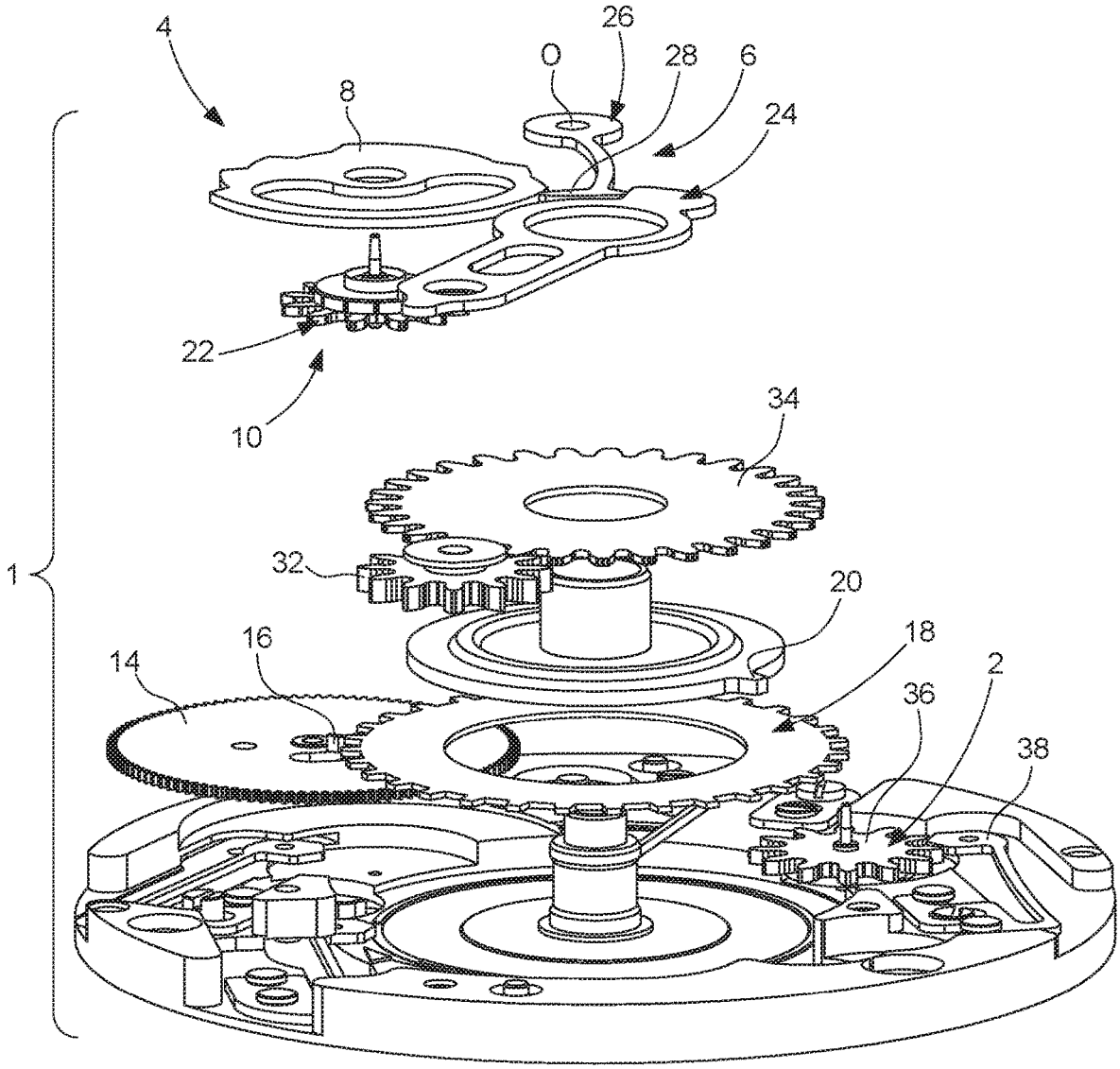
FIG. 2 is a perspective and exploded view of the display device in FIG. 1.

Denoted as a whole by the general reference numeral 1, the device for displaying a succession of periodic events which form an annual cycle according to the invention comprises (see FIGS. 1 and 2) a periodic events indicator member 2 on which the periodic events to be displayed are shown. The display device 1 further comprises a management mechanism 4 for managing a duration during which the periodic events are displayed. This management mechanism 4 in particular comprises a member 6 arranged such that it drives the periodic events indicator member 2 during an event change. The management mechanism 4 further comprises a management cam 8 for managing the duration during which the periodic events are displayed, and drive means 10 for driving the management cam 8.

Figure 3:
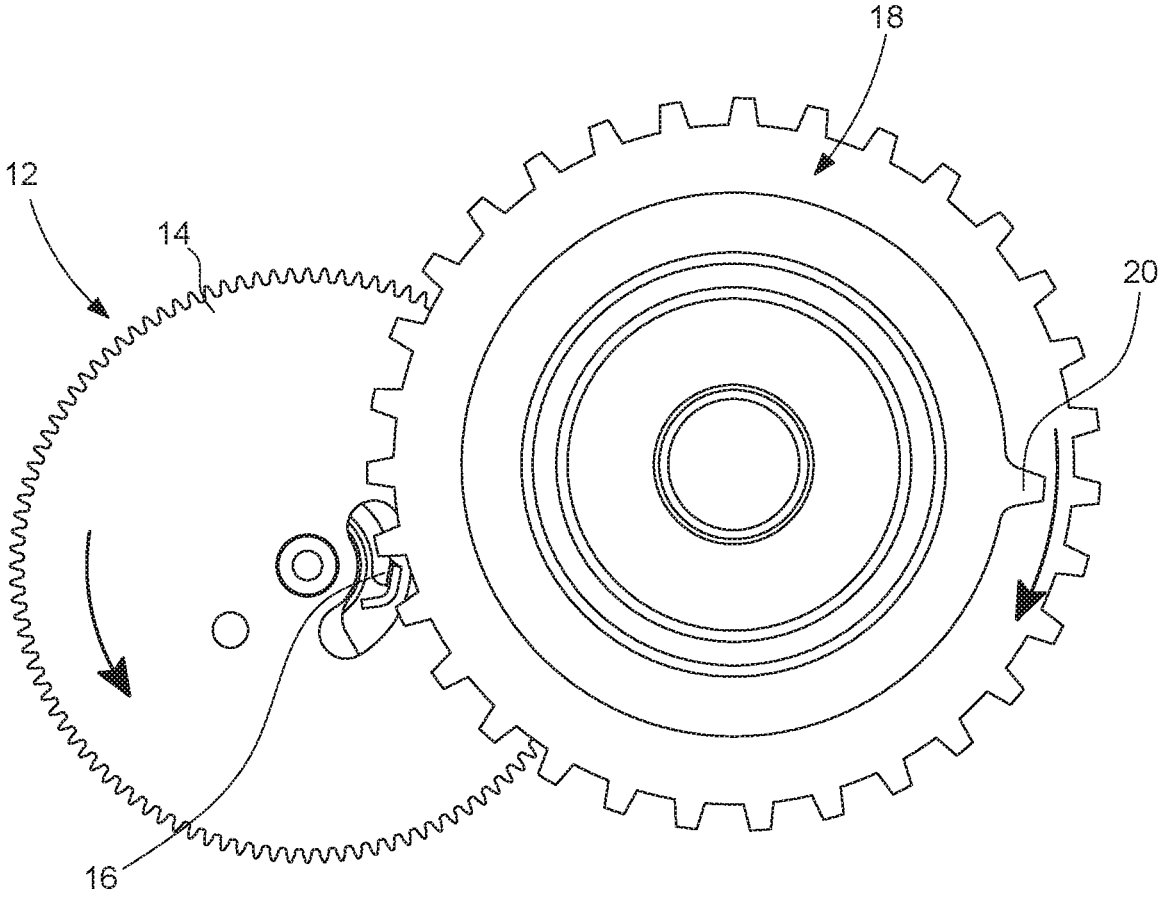
FIG. 3 is a detailed view of the display device according to the invention, which shows the driving of the date indicator wheel by the date drive wheel.

More specifically, the management member 4 for managing the duration during which the periodic events are displayed comprises a date mechanism 12 driven by a horological movement (not shown). This date mechanism 12 is provided with a date drive wheel 14 which rotates one revolution per day and which comprises a date drive finger 16. Every day, at about midnight, the date drive wheel 14, via the date drive finger 16 thereof, causes a date indicator wheel 18 to advance by one step (see FIG. 3).

Figure 4:
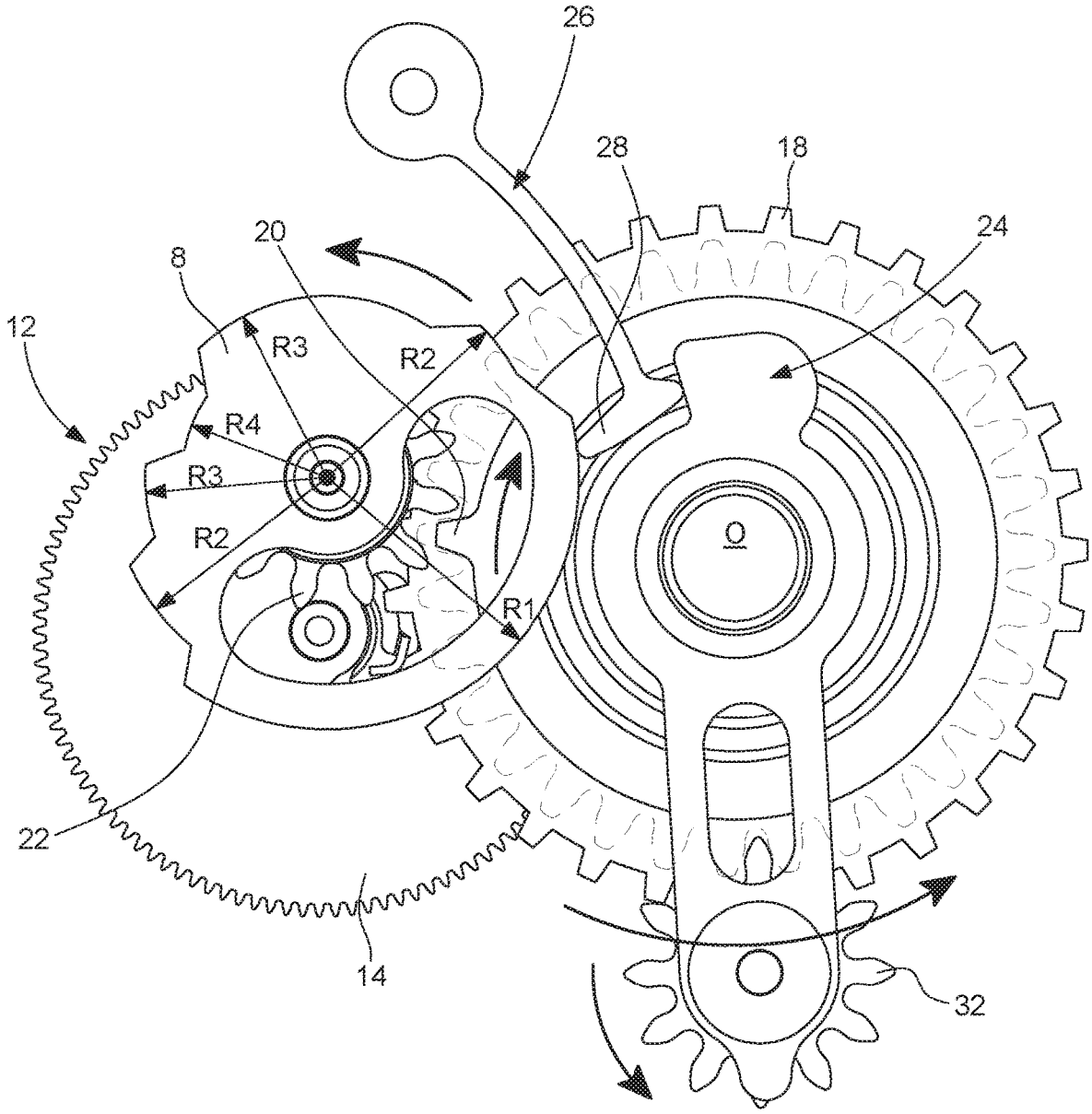
FIG. 4 is a detailed view of the display device according to the invention, which shows the driving of the month indicator wheel by the month drive finger.

The date indicator wheel 18 is provided with a month drive finger 20 arranged on a circle concentric to the date indicator wheel 18 (see FIG. 4). On the $31^{st}$ of each month, this month drive finger 20 causes a month indicator wheel 22 to advance by one step, to which wheel is fixed the management cam 8 for managing the duration during which the periodic events are displayed. It is understood that the month indicator wheel 22 and the associated management cam 8 thereof perform one full revolution per year by advancing by 30° at the end of the $31^{st}$ of each month.

The information carried by the management cam 8 is communicated to a lever 24 mounted concentrically to the date indicator wheel 18 either directly or, as shown by the example in the drawing, via a hammer 26 equipped with a feeler-spindle 28 which follows the profile of the management cam 8, the lever 24 being held such that it bears elastically thereagainst by means of a return spring 30.

The display device 1 described here is arranged such that it displays the succession of the 12 signs of the zodiac. Nonetheless, it must be understood that this example is given for illustrative purposes only and that, by adapting the profile of the management cam 8, another succession of periodic events having the particularity of forming an annual cycle can be displayed. Displaying the Chinese horoscope is in particular a possibility.

In the so-called tropical zodiac system to which reference is made herein, the 12 periods of the zodiac begin, depending on the case, on the $20^{th}$, $21^{st}$, $22^{nd}$ or $23^{rd}$ of the month concerned. Moreover, when two successive periods of the zodiac do not begin on the same day of the month, there is never more than a one day difference between the start of the first period of the zodiac considered and the start of the period of the zodiac immediately thereafter. More specifically, from March to May, the periods of the zodiac concerned, that is to say Aries, Taurus and Gemini, all begin on the $21^{st}$ of the month. The following period of the zodiac, that is to say that of Cancer, starts on the $22^{nd}$ of June. From July to November, the corresponding periods of the zodiac, that is to say Leo, Virgo, Libra, Scorpio and Sagittarius, all begin on the $23^{rd}$ of the month. In December, the period of Capricorn begins on the $22^{nd}$, in January, the period of Aquarius begins on the $21^{st}$, and in February, the period of Pisces begins on the $20^{th}$.

As will be better understood after reading the following paragraphs, the profile of the management cam 8 is arranged such that the indicator member 2 changes zodiac period on the first day of the zodiac period considered. Thus, the profile of the management cam 8 has a first radius R1 which will allow, via the hammer 26 and the lever 24, the indicator member 2 to change zodiac period during the night of the $22^{nd}$ to the $23^{rd}$ of the months of July, August, September, October and November. Similarly, the profile of the management cam 8 has a second radius R2 which is different from the first radius R1, which will allow the indicator member 2 to change zodiac period during the night of the $21^{st}$ to the $22^{nd}$ of the months of June and December. Similarly, the profile of the management cam 8 has a third radius R3 which is different from the first and second radii R1 and R2, which will allow the indicator member 2 to change zodiac period during the night of the $20^{th}$ to the $21^{st}$ of the months of January, March, April and May. Finally, the profile of the management cam 8 has a fourth radius R4 which is different from the radii R1, R2 and R3, which will allow the indicator member 2 to change zodiac period during the night of the $19^{th}$ to the $20^{th}$ of the month of February. Thus, the profile of the management cam 8 has a first portion of radius R1 that is constant for the months of July, August, September, October and November, then a second portion of radius R2 for the month of December, then a third portion of radius R3 for the month of January, then a fourth portion of radius R4 for the month of February, then a fifth portion of radius R3 that is constant for the months of March, April and May, and finally a sixth and last portion of radius R2 corresponding to the month of June.

Figure 5:
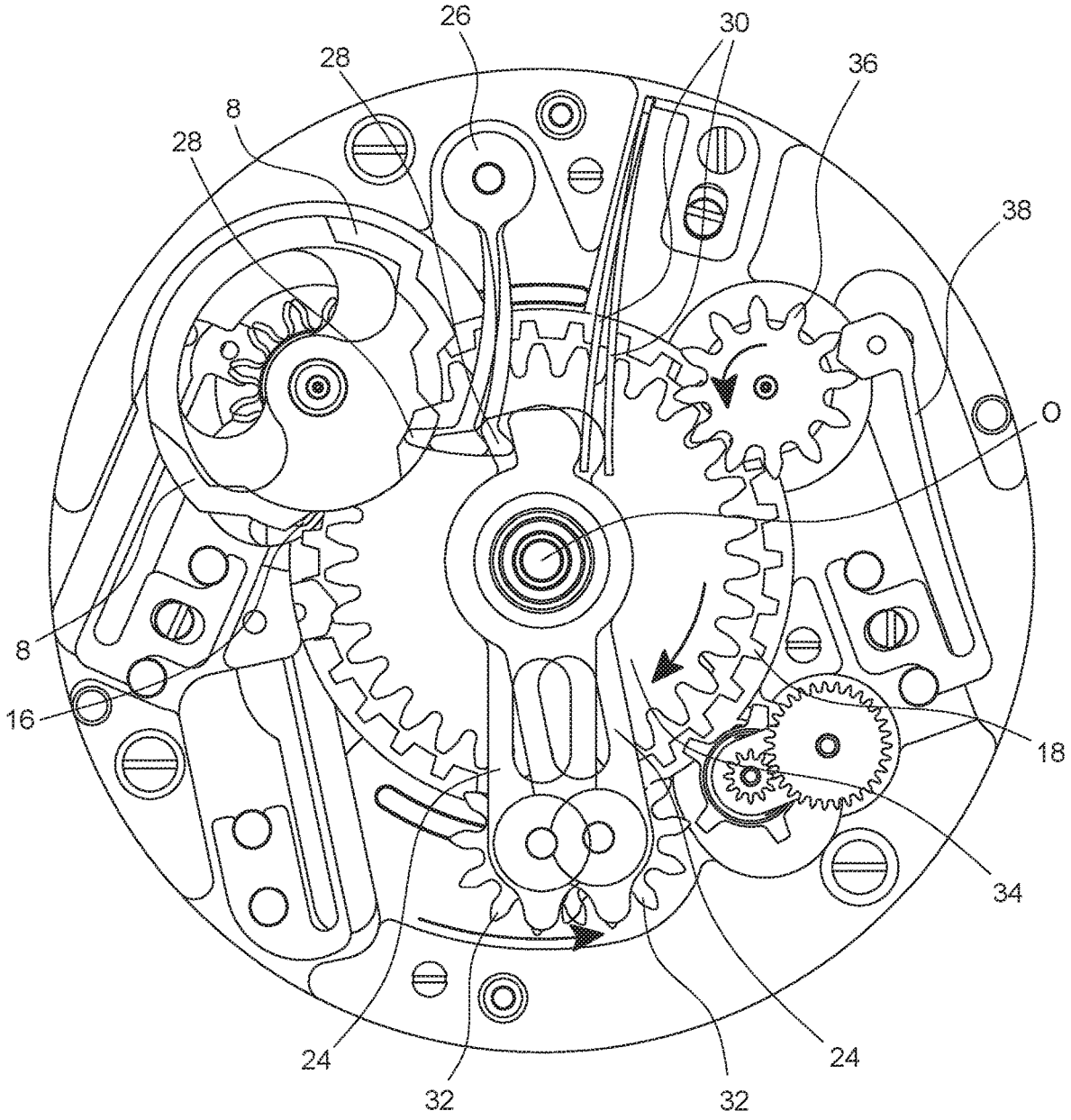
FIG. 5 is an overhead view which, in the same figure, shows the position of the lever for the period of Aquarius and for the period of Pisces.
Figure 6:
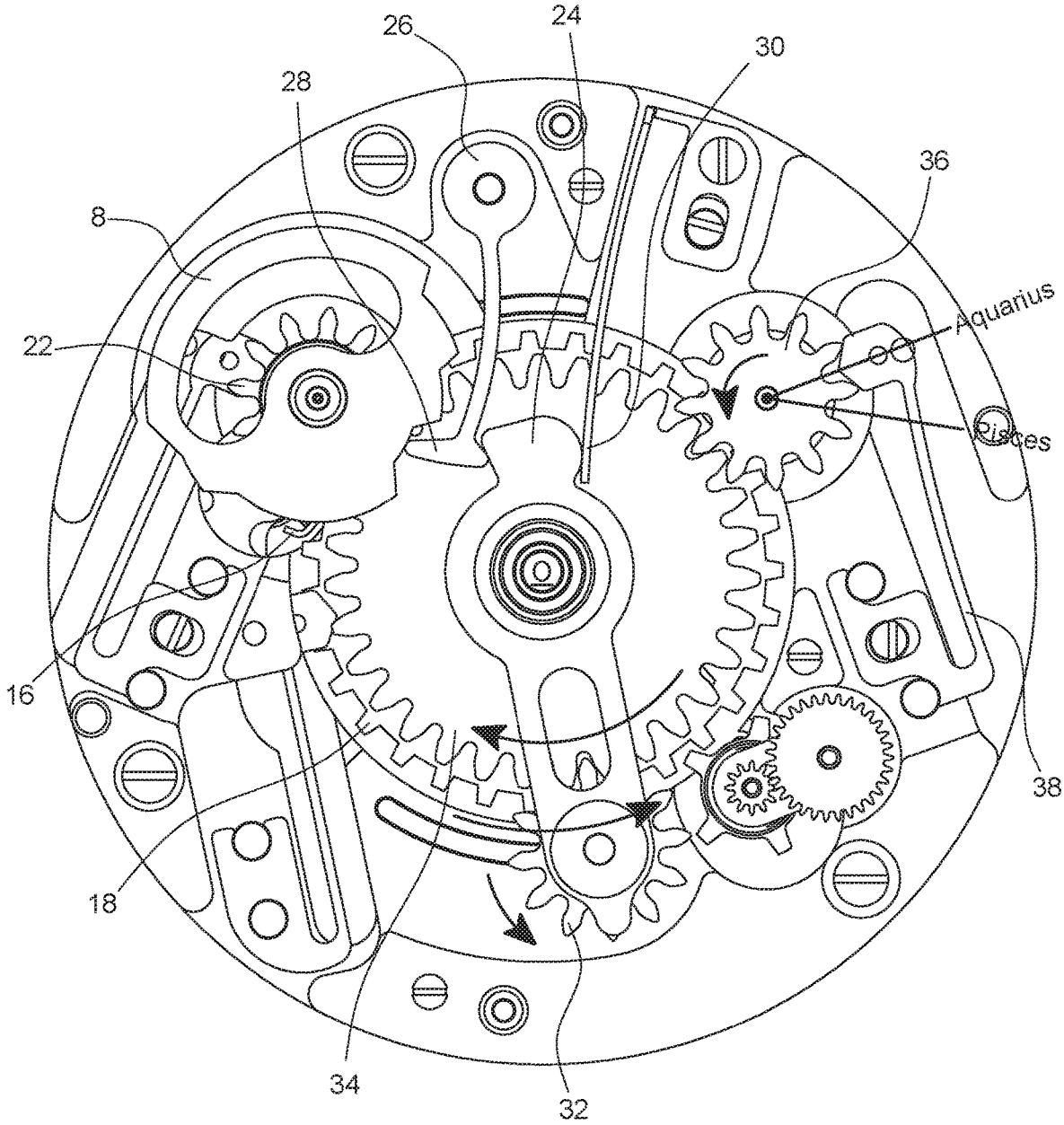
FIG. 6 is a large-scale overhead view that shows the situation of the display device according to the invention on the $16^{th}$ of February for the period of Aquarius which extends from the $21^{st}$ of January to the $19^{th}$ of February.

For the purposes of illustration, for the period from the $21^{st}$ of January to the $19^{th}$ of February, the indicator member 2 displays the zodiac period of Aquarius (see FIGS. 5 and 6). In the situation shown in FIG. 6 wherein the display device 1 according to the invention shows the $16^{th}$ of February, the lever 24 is prepositioned so as to allow the indicator member 2 to change from the zodiac period of Aquarius to the zodiac period of Pisces during the night of the $19^{th}$ to the $20^{th}$ of February. At the end of the month of February, the month drive finger 20 causes the month indicator wheel 22 to advance by one step, to which wheel is fixed the management cam 8 for managing the duration during which the periodic events are displayed. Under the effect of the pivoting of the management cam 8, the feeler-spindle 28 of the hammer 26 moves from the fourth portion of radius R4 of the profile of the management cam 8 to the fifth portion of radius R3 of the profile of the management cam 8. This change in radius of curvature of the profile of the management cam 8 will be transmitted, via the feeler-spindle 28 of the hammer 26, to the lever 24 which is held such that it elastically bears against the hammer 26 by means of the return spring 30.

Figure 7:
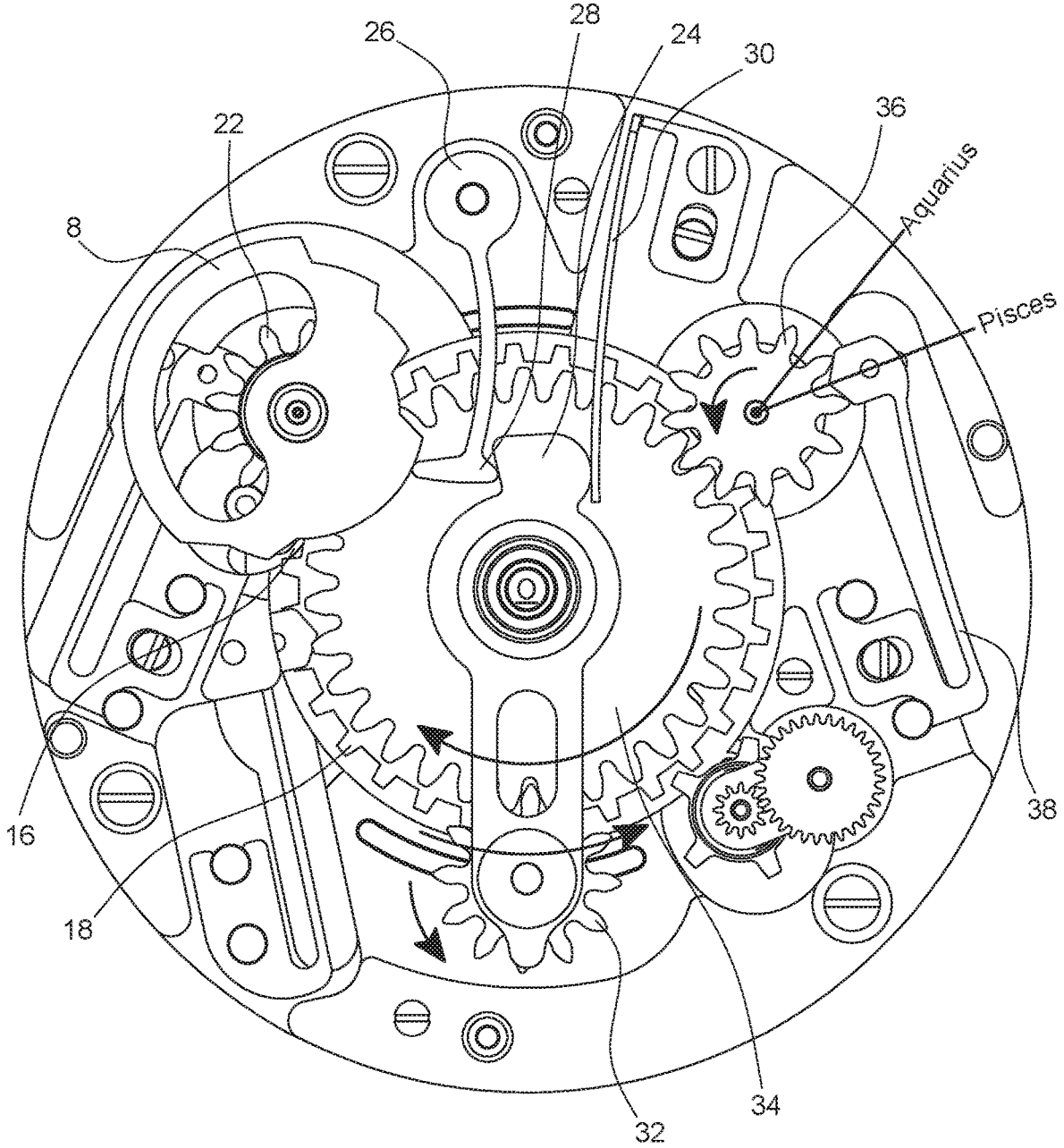
FIG. 7 is a large-scale overhead view that shows the situation of the display device according to the invention on the $16^{th}$ of March for the period of Pisces which extends from the $20^{th}$ of February to the $20^{th}$ of March.

The change in the radius of curvature of the profile of the management cam 8 will control the pivoting of the lever 24 about a centre of rotation O (see FIGS. 5 and 7). Under the effect of this pivoting, a planetary wheel 32, mounted such that it idles at the end of the lever 24, rotates about itself and about the centre of rotation O. During this movement, the planetary wheel 32 rolls on a toothing of a sun wheel 34, which remains fixed. This sun wheel 34 is mounted such that it can rotate about the centre of rotation O of the lever 24, concentrically to the date indicator wheel 18. Once the change in the radius of curvature of the profile of the management cam 8 has occurred at the end of the month of February and once the lever 24 has pivoted accordingly, the latter again remains non-moving until the end of the month of March and the display device 1 according to the invention is prepositioned to allow the indicator member 2 to change from the zodiac period of Pisces to the zodiac period of Aries during the night of the $20^{th}$ to the $21^{st}$ of March.

Figure 8:
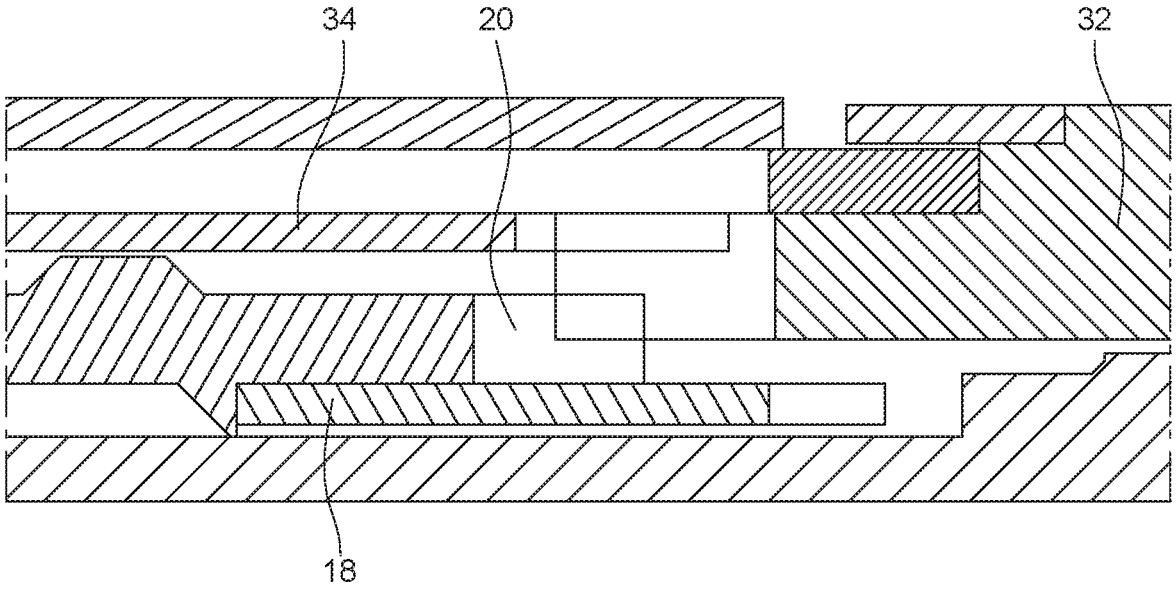
FIG. 8 is a sectional view showing the month drive finger driving the planetary wheel which itself drives the sun wheel.

When changing the radius of curvature of the profile of the management cam 8 at the time of passing from the end of the month of February to the first day of the month of March, the lever 24 adopts a new position which will then allow the indicator member 2 to change from the indication of the zodiac period of Pisces to the indication of the zodiac period of Aries shortly before midnight during the night of the $20^{th}$ to the $21^{st}$ of March. More specifically, during the period that separates the end of the month of February from the $20^{th}$ of March, the date drive wheel 14 rotates at a rate of one revolution per day and causes the date indicator wheel 18 to advance by one step per day. The month drive finger 20 advances together with the date indicator wheel 18. Controlled by the management cam 8, the position of the lever 24 is such that, when passing from the $20^{th}$ to the $21^{st}$ day of the month of March, the month drive finger 20 rotates the planetary wheel 32 (see FIG. 8). Since the lever 24 is held by the return spring 30 thereof such that it bears against the hammer 26, it cannot pivot, such that the planetary wheel 32 rotates the sun wheel 34. In turn, the sun wheel 34 causes a zodiac indicator wheel 36 showing the indications of the twelve signs of the zodiac to advance by one step, the position of which wheel is indexed by a jumper 38. Thus, the indication of the zodiac changes from Pisces to Aries.

It is evident that the present invention is not limited to the embodiment described above and that various simple alternatives and modifications can be considered by a person skilled in the art without leaving the scope of the invention as defined by the accompanying claims. In particular, it must be understood that, although the present invention has been described in relation to the display of the twelve periods of the zodiac, this invention is not limited to such an embodiment and can be applied to the display of other periodic events forming an annual cycle. Displaying the Chinese horoscope is in particular a possibility. It should also be noted that, on the $31^{st}$ of every month, the month drive finger drives the month indicator wheel and that, once a month, on the day of the change in period of the zodiac, the month drive finger drives the planetary wheel which itself drives the zodiac indicator wheel via the sun wheel. It must also be understood that at the end of the months having less than 31 days, the date mechanism must be advanced to the date "1" in order to guarantee that the display device according to the invention remains appropriately indexed relative to the calendar.

NOMENCLATURE

1. Device for displaying a succession of periodic events which form an annual cycle
2. Periodic events indicator member
4. Mechanism for managing a duration during which the periodic events are displayed
6. Drive member
8. Management cam for managing the duration during which the periodic events are displayed
10. Drive means for driving the management cam
12. Date mechanism
14. Date drive wheel
16. Date drive finger
18. Date indicator wheel
20. Month drive finger
22. Month indicator wheel
24. Lever
26. Hammer
28. Feeler-spindle
30. Return spring
32. Planetary wheel
34. Sun wheel
36. Zodiac indicator wheel
38. Jumper

The invention claimed is:

1. A device for displaying a succession of periodic events which form an annual cycle, this display device (1) comprising:

a periodic events indicator member (2);

a mechanism (4) for managing a duration during which the periodic events are displayed by the periodic events indicator member (2), this management mechanism (4) comprising:

a cam (8) for managing a duration during which the periodic events are displayed, which cam is arranged such that it controls the change from the indication of a periodic event to the indication of a subsequent periodic event by the periodic events indicator member (2);

periodic drive means (10) for driving the management cam (8), and a member (6) disposed between the management cam (8) and the periodic events indicator member (2) and arranged such that it drives the periodic events indicator member (2) during a change in event, wherein the drive member (6) disposed between the management cam (8) and the periodic events indicator member (2) comprises a lever (24) that bears against a profile of the cam (8) for managing the duration during which the periodic events are displayed, wherein the management cam (8) is driven by a date mechanism (12) and by a month mechanism, wherein the date mechanism (12) comprises a date drive wheel (14) which drives a date indicator wheel (18) at a rate of one step per day, this date indicator wheel (18) performing one full revolution in 31 days, the month mechanism comprising a month drive finger (20) integral with the date indicator wheel (18) and which causes the management cam (8) to advance by one twelfth of a revolution at the end of each of the twelve months of the year, wherein the display device further comprises a planetary wheel (32) mounted to idle on the lever (24) and which meshes with a sun wheel (34), and wherein the date indicator wheel (18), the month drive finger (20), the sun wheel (34) and the lever (24) are concentric.

2. The display device according to claim 1, wherein, at the beginning of the months in which the periodic event change must take place on a day of this month that is different to the day of the month on which the previous periodic event change took place, the management cam (8) controls the adjustment to the position of the lever (24), whereby the planetary wheel (32) rolls on the sun wheel (34) which remains fixed during the adjustment to the position of the lever (24).

3. The display device according to claim 2, wherein, on the day of the month on which the periodic event change takes place, the month drive finger (20) meshes with the planetary wheel (32), which itself rotates the sun wheel (34).

4. The display device according to claim 3, wherein the sun wheel (34) drives the periodic events indicator member (2).

5. The display device according to claim 4, wherein the periodic events indicator member (2) is a periodic events indicator wheel (36) which is indexed by a jumper (38) and with which the sun wheel (34) meshes.

6. A device for displaying a succession of periodic events which form an annual cycle, this display device (1) comprising:

a periodic events indicator member (2);

a mechanism (4) for managing a duration during which the periodic events are displayed by the periodic events indicator member (2), this management mechanism (4) comprising:

a cam (8) for managing a duration during which the periodic events are displayed, which cam is arranged such that it controls the change from the indication of a periodic event to the indication of a subsequent periodic event by the periodic events indicator member (2);

periodic drive means (10) for driving the management cam (8), and a member (6) disposed between the management cam (8) and the periodic events indicator member (2) and arranged such that it drives the periodic events indicator member (2) during a change in event, wherein the display device is adapted to display the zodiac periods, and wherein the profile of the management cam (8) has a first radius (R1) which allows the indicator member (2) to change zodiac period during the night of the 22nd to the 23rd of the months of July, August, September, October and November, a second radius (R2) which is different from the first radius (R1), which allows the indicator member (2) to change zodiac period during the night of the 21st to the 22nd of the months of December and June, a third radius (R3) which is different from the first and second radii (R1) and (R2), which allows the indicator member (2) to change zodiac period during the night of the 20th to the 21st of the months of January, March, April and May, and a fourth radius (R4) which is different from the first, second and third radii (R1), (R2) and (R3), which allows the indicator member (2) to change zodiac period during the night of the 19th to the 20th of the month of February.

7. The display device according to claim 6, wherein the profile of the management cam (8) has a first portion of radius (R1) that is constant for the months of July, August, September, October and November, then a second portion of radius (R2) for the month of December, then a third portion of radius (R3) for the month of January, then a fourth portion of radius (R4) for the month of February, then a fifth portion of radius (R3) that is constant for the months of March, April and May, and finally a sixth and last portion of radius (R2) corresponding to the month of June.

8. Timepiece comprising a device for displaying a succession of periodic events which form an annual cycle according to claim 6.

* * * * *